US009810216B2

(12) United States Patent
Tsukahara et al.

(10) Patent No.: US 9,810,216 B2
(45) Date of Patent: Nov. 7, 2017

(54) VANE PUMP UNIT

(71) Applicant: Showa Corporation, Gyoda-shi (JP)

(72) Inventors: Yoshihiro Tsukahara, Haga-gun (JP); Naoya Taga, Haga-gun (JP)

(73) Assignee: SHOWA CORPORATION, Gyoda-Shi (JP)

( * ) Notice: Subject to any disclaimer, the term of this patent is extended or adjusted under 35 U.S.C. 154(b) by 103 days.

(21) Appl. No.: 14/496,448

(22) Filed: Sep. 25, 2014

(65) Prior Publication Data

US 2015/0204326 A1 Jul. 23, 2015

(30) Foreign Application Priority Data

Jan. 21, 2014 (JP) ..... 2014-008628

(51) Int. Cl.
*F04C 14/22* (2006.01)
*F04C 2/344* (2006.01)
*F01C 21/10* (2006.01)

(52) U.S. Cl.
CPC ..... *F04C 14/223* (2013.01); *F01C 21/104* (2013.01); *F01C 21/108* (2013.01); *F04C 2/344* (2013.01); *F04C 2/3441* (2013.01); *F04C 2/3442* (2013.01); *F04C 2/3446* (2013.01); *F04C 14/226* (2013.01); *F04C 2230/60* (2013.01); *F04C 2240/30* (2013.01); *F04C 2240/805* (2013.01)

(58) Field of Classification Search
CPC .... F04C 2/3442; F04C 14/226; F04C 2/3446; F04C 14/223; F04C 2/344; F04C 2/3441; F04C 18/3441; F04C 2240/30; F04C 2230/60; F04C 2240/805; F01C 21/108; F01C 21/104
See application file for complete search history.

(56) References Cited

U.S. PATENT DOCUMENTS 6,123,532 A * 9/2000 Lauth ..... F01C 21/108 418/132
6,358,020 B1 * 3/2002 Staton ..... F01C 21/104 29/888.025
2002/0119065 A1 * 8/2002 Palakodati ..... F01C 21/0863 418/259
2002/0131873 A1 * 9/2002 Staton ..... F04C 14/28 417/310

FOREIGN PATENT DOCUMENTS

JP 2002-021742 A 1/2002

* cited by examiner

*Primary Examiner* — Mark Laurenzi
*Assistant Examiner* — Wesley Harris
(74) *Attorney, Agent, or Firm* — Leason Ellis LLP

(57) ABSTRACT

A vane pump unit assembled into a housing includes a rotor; a plurality of vanes; a cam ring; a first plate; a second plate; a connecting bar that has a first end portion fixed to the first plate, and a second end portion which protrudes from the second plate; and a clip that prevents the second plate and the cam ring from slipping out of the connecting bar. Before the clip is assembled into the housing, the retaining of the clip is positioned at least either between the first plate and the cam ring or between the second plate and the cam ring, in a place where a gap is formed. After the clip is assembled into the housing, the housing interposes the first plate, the cam ring, and the second plate in the axial direction, and the first and second plates are in close contact with the cam ring.

7 Claims, 7 Drawing Sheets

< AFTER ASSEMBLY >

< BEFORE ASSEMBLY >

VANE PUMP UNIT

CROSS-REFERENCE TO RELATED APPLICATIONS

This application is based on and claims priority under 35 USC 119 from Japanese Patent Application No. 2014-008628 filed on Jan. 21, 2014, the entire content of which is incorporated herein by reference.

BACKGROUND

1. Technical Field

The present invention relates to a vane pump unit.

2. Related Art

A vane pump is known as a fluid pressure-feed device. For example, the vane pump includes a vane pump unit (a vane pump main body), and a housing which rotatably accommodates the vane pump unit and in which a suction path and a discharge path are formed (refer to JP-A-2002-21742). The vane pump unit includes a rotor that rotates integrally with a power input shaft; a plurality of vanes that are slidably (advanceably and retractably) provided in the rotor; a cam ring that surrounds the rotor and the vanes; a pair of plates (a first plate and a second plate) that interpose the rotor and the cam ring therebetween on opposite sides in an axial direction of the power input shaft; and two connecting bars that pass through the cam ring in the axial direction, and connect the first and second plates. One end portion of each of the connecting bars is press fitted into the first plate, and the other end portion of the connecting bar is press fitted into the second plate.

SUMMARY OF INVENTION

Since one end portion of the connecting bar is press fitted into the first plate, and the other end portion of the connecting bar is press fitted into the second plate, there is the possibility that variations in a press-fit load and an amount of press fit may occur. Accordingly, for example, there is a problem in that when the amount of press fit is greater than a design specification, that is, when the connecting bar is excessively press fitted into the plate, the first plate and/or the second plate deform and bend, thereby causing variations of very small gaps formed between the first plate and/or the second plate, the cam ring and the rotor. Specifically, when the very small gaps increase in size further than the design specification, a fluid is likely to leak. When the very small gaps decrease in size further than the design specification, sliding resistance between the rotor and the plates increases, thereby the rotor is unlikely to rotate, and the rotor and the plates are seized together.

An object of the present invention is to provide a vane pump unit, plates of which are unlikely to bend.

In an embodiment of the present invention to achieve the problems, provided is a vane pump unit that is assembled into a housing of a vane pump. The pump unit includes a rotor; a plurality of vanes that are slidably provided in the rotor; an annular cam ring that surrounds the rotor and the plurality of vanes; a first plate that is disposed on one end surface side of the rotor; a second plate that is disposed on the other end surface side of the rotor; a connecting bar that passes through the cam ring in an axial direction, and has a first end portion fixed to the first plate, and a second end portion which passes through the second plate and then protrudes from the second plate; and a retainer that is retained in the second end portion of the connecting bar, and prevents the second plate and the cam ring from slipping out of the connecting bar. Before the retainer is assembled into the housing, the retaining of the retainer is positioned in a place such that a gap is formed at least either between the first plate and the cam ring or between the second plate and the cam ring. After the retainer is assembled into the housing, the housing interposes the first plate, the cam ring, and the second plate in the axial direction, and the first and second plates are in close contact with the cam ring.

The vane pump unit may include a power input shaft that is fixed onto a center axis of the rotor, and receives power from an external power generation apparatus.

In this configuration, the first end portion of the connecting bar is fixed to the first plate, and then the cam ring and the second plate pass through the second end portion of the connecting bar in sequence. The second end portion of the connecting bar protrudes from the second plate. At this time, since the connecting bar is not press fitted into the second plate, the second plate does not bend in a plate thickness direction (in the axial direction of the connecting bar).

Subsequently, the second end portion of the connecting bar is retained by the retainer, thereby the vane pump unit is assembled. The retainer retained in the second end portion prevents the second plate and the cam ring from slipping out of the connecting bar.

Here, since the retaining of the retainer is positioned in a place such that a gap is formed at least either between the first plate and the cam ring or between the second plate and the cam ring, the first and second plates are not in press contact with the cam ring in a state where the retainer is retained in the connecting bar. Accordingly, the first and second plates do not bend in the plate thickness direction.

Subsequently, the vane pump unit is assembled into the housing, thereby the vane pump is obtained.

When the vane pump unit is assembled into the housing, the housing interposes the first plate, the cam ring, and the second plate in the axial direction, and the first and second plates are in close contact with the cam ring. Accordingly, a fluid is unlikely to leak from between the first plate and the cam ring, and between the second plate and the cam ring.

In the vane pump unit, the second end portion of the connecting bar may be provided with a contact surface that is in contact with the retainer in the axial direction.

In this configuration, the retainer is brought into contact with the contact surface formed on the second end portion of the connecting bar, thereby the retainer is easily determined to be in a predetermined position in the axial direction of the connecting bar.

In the vane pump unit, the second end portion of the connecting bar may be provided with an attachment groove into which the retainer is attached, and which extends in a circumferential direction of the connecting bar. The retainer may have a C shape when seen in the axial direction.

In this configuration, the retainer having a C shape when seen in the axial direction is attached into the attachment groove that is formed in the second end portion so as to extend in the circumferential direction, thereby it is possible to easily attach the retainer to the connecting bar.

According to the embodiment of the present invention, it is possible to provide the vane pump unit, the plates of which are unlikely to bend.

DESCRIPTION OF EMBODIMENTS

Figure 1:
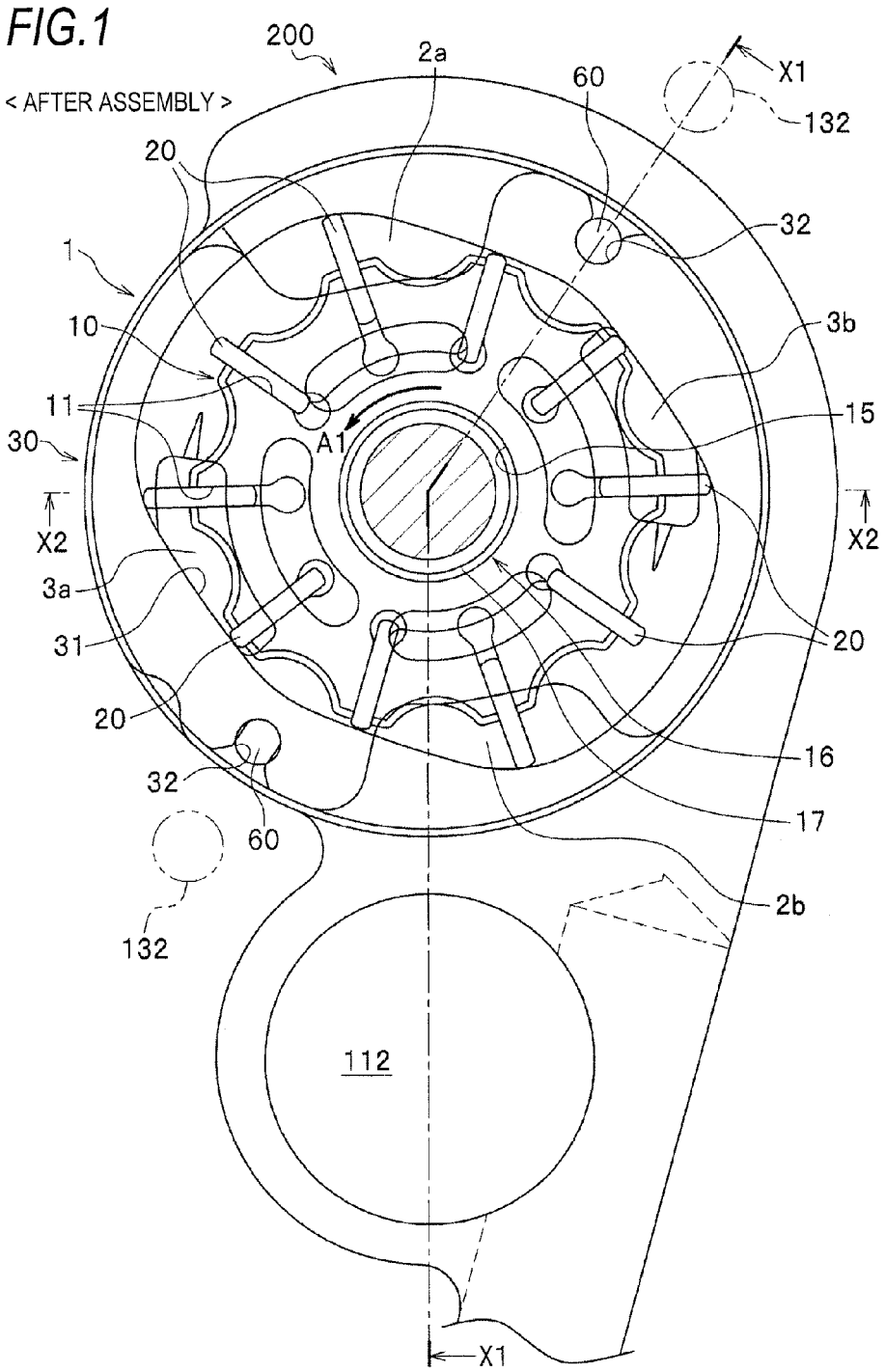
FIG. 1 is a front view of a vane pump according to an embodiment, illustrating a state in which a vane pump unit is assembled.

An embodiment of the present invention will be described with reference to FIGS. 1 to 5B.

Configuration of Vane Pump

A vane pump 200 is a device that supplies oil (a fluid) to fluid using equipment. The following exemplifies the fluid using equipment: a continuous variable transmission that steplessly changes a gear ratio via the stepless variable winding diameter of a belt wound around a drive pulley and a driven pulley, corresponding to a oil pressure; a hydraulic cylinder of a hydraulic power steering apparatus; and so on.

The vane pump 200 is a constant displacement pump that has a constant amount of discharge. While a rotor 10 rotates one revolution, the vane pump 200 executes two pumping strokes, that is, a suction stroke, a discharge stroke, a suction stroke, and then a discharge stroke. A cam ring 30 may be a variable type in which the cam ring 30 reciprocates in a radial direction, thereby the amount of discharge is variable. While the rotor 10 rotates one revolution, the vane pump 200 may execute one pumping stroke or more than three pumping strokes. A plurality of vanes 20 may be disposed in multiple stages in an axial direction.

The vane pump 200 includes a vane pump unit 1 (a vane pump main body) that has a substantially columnar exterior appearance, and a housing 100 that accommodates the vane pump unit 1 therein.

Housing

The housing 100 includes a bottomed cylindrical housing main body 110 having a shallow depth, and a cover 120 with which an opening of the housing main body 110 is covered. The housing main body 110 and the cover 120 are tightened together with a bolt 131.

Housing Main Body

The following is formed inside of the housing main body 110: a columnar accommodating chamber 111 that accommodates the vane pump unit 1; a suction path 112; and a discharge path 113.

The suction path 112 is a flow path that allows the oil suctioned into the vane pump unit 1 to pass therethrough. A reservoir (not illustrated) is connected to an end upstream of the suction path 112 via an external suction flow path (not illustrated), and temporarily stores the oil therein. A side downstream of the suction path 112 branches into two paths, a first suction path 112*a* and a second suction path 112*b*. An end downstream of the first suction path 112*a* communicates with a first suction port 2*a* of the vane pump unit 1, and an end downstream of the second suction path 112*b* communicates with a second suction port 2*b* of the vane pump unit 1.

The discharge path 113 is a flow path that allows the oil discharged from the vane pump unit 1 to pass therethrough. A side upstream of the discharge path 113 branches into two paths, a first discharge path 113*a* and a second discharge path 113*b*. An end upstream of the first discharge path 113*a* communicates with a first discharge port 3*a* of the vane pump unit 1, and an end upstream of the second discharge path 113*b* communicates with a second discharge port 3*b* of the vane pump unit 1.

Two pins 132 (refer to FIGS. 1 and 2) are inserted through the cover 120 and a second plate 50 in the axial direction. Accordingly, the circumferential position of each of the cover 120 (the housing 100) and the second plate 50 (the vane pump unit 1) is determined.

An O-ring 133 is provided between a bottom wall portion 110*a* of the housing main body 110 and a first plate 40 so as to surround the first discharge path 113*a* and the second discharge path 113*b*. That is, the O-ring 133 is interposed between the bottom wall portion 110*a* and the first plate 40 in the axial direction. The O-ring 133 seals the first discharge path 113*a* and the second discharge path 113*b* so as to prevent oil leakage.

Configuration of Vane Pump Unit

The vane pump unit 1 has a substantially columnar exterior appearance. As described above, while the rotor 10 rotates one revolution, the vane pump unit 1 executes a suction stroke, a discharge stroke, a suction stroke, and then a discharge stroke. The first suction port 2*a*, the first discharge port 3*a*, the second suction port 2*b*, and the second discharge port 3*b* are disposed in an outer surface of the vane pump unit 1 in sequence in the circumferential direction (refer to FIG. 1).

Each of the first suction port 2*a* and the second suction port 2*b* are an entrance of the oil to the vane pump unit 1, and is opened in the outer surface of the vane pump unit 1. Each of the first discharge port 3*a* and the second discharge port 3*b* is an exit of the oil from the vane pump unit 1, and is opened in an end surface (a right end surface in FIGS. 2 and 3) of the vane pump unit 1.

Figure 2:
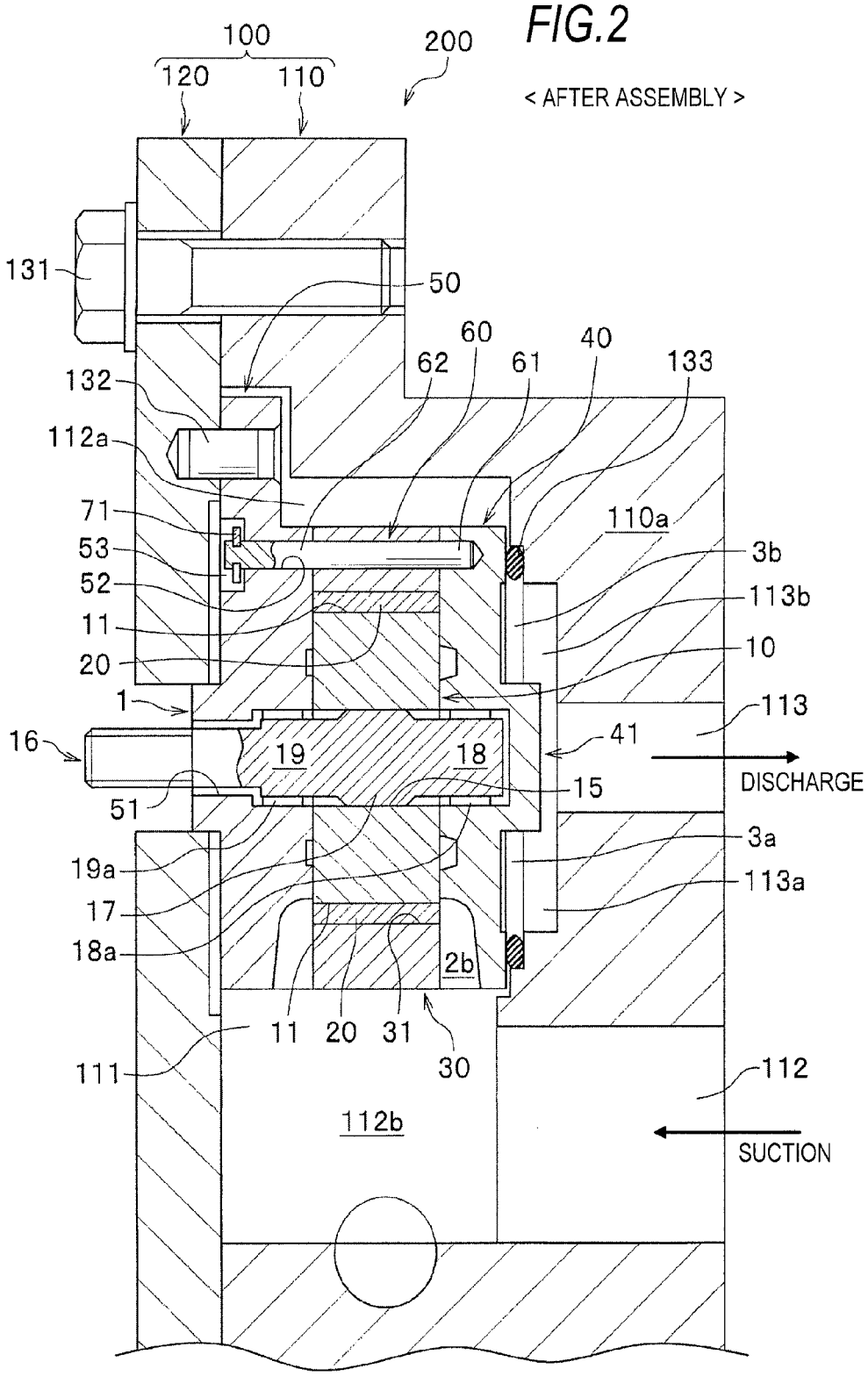
FIG. 2 is a side cross-sectional view of the vane pump according to the embodiment, corresponding to a cross-section taken along line X1-X1 in FIG. 1, and illustrating a state in which the vane pump unit is assembled.
Figure 3:
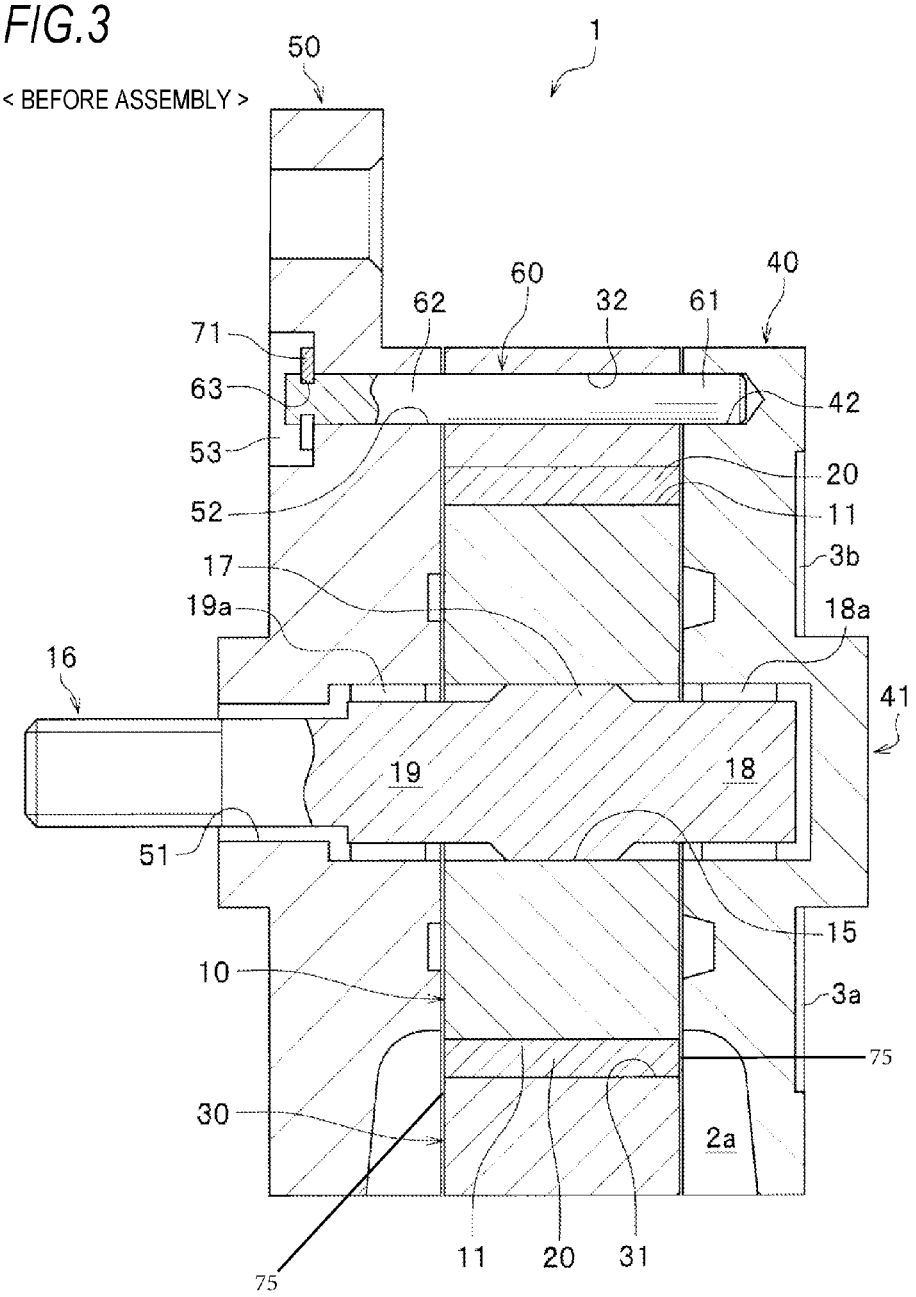
FIG. 3 is a side cross-sectional view of the vane pump unit according to the embodiment, illustrating a state in which the vane pump unit is not assembled.

The vane pump unit 1 includes the rotor 10; ten pieces of (the plurality of) vanes 20; the cam ring 30; the first plate 40; the second plate 50; two (a plurality of) connecting bars 60; and two clips 71 (refer to FIGS. 1 to 3).

Rotor

The rotor 10 has a substantially columnar shape. The rotor 10 is provided with ten (a plurality of) vane grooves 11 that extend from an outer circumferential surface of the rotor 10 inwardly in a radial direction. The ten vane grooves 11 are disposed at equal intervals in the circumferential direction.

A serration hole 15 is formed on the center axis of the rotor 10. A serration shaft portion 17 of a shaft 16 is fitted into the serration hole 15. The rotor 10 and the shaft 16 are united together via a serration connection, and rotate in a counter-clockwise direction in FIG. 1 (refer to arrow A1). The shaft 16 receives power from an external power generation apparatus. Alternatively, the vane pump unit 1 may have a configuration in which the vane pump unit 1 is not provided with the shaft 16, and after the vane pump unit 1 is assembled into the housing 100, the shaft 16 is fitted into the serration hole 15.

Vane

The vanes 20 are sliding pieces that are respectively provided in the plurality of vane grooves 11, and are slidable in the radial direction. When the rotor 10 rotates, a centrifugal force is exerted on each of the vanes 20, thereby the tip of each of the vanes 20 is brought into sliding contact with a cam surface (an inner circumferential surface) 31 of the cam ring 30.

Cam Ring

The cam ring 30 is a cylindrical component having a thickness that is disposed coaxially with the rotor 10 so as to surround the rotor 10 and the vanes 20. The cam surface 31 of the cam ring 30 has a substantially elliptical shape when seen in the axial direction.

A through-hole 32 (refer to FIG. 3) is formed inside of the cam ring 30. The through-hole 32 extends in the axial direction, and has open opposite sides. The connecting bar 60 passes through the through-hole 32, and the inner diameter of the through-hole 32 is greater than the outer diameter of the connecting bar 60.

Height of Rotor, Vane, and Cam Ring (Axial Length)

Figure 4:
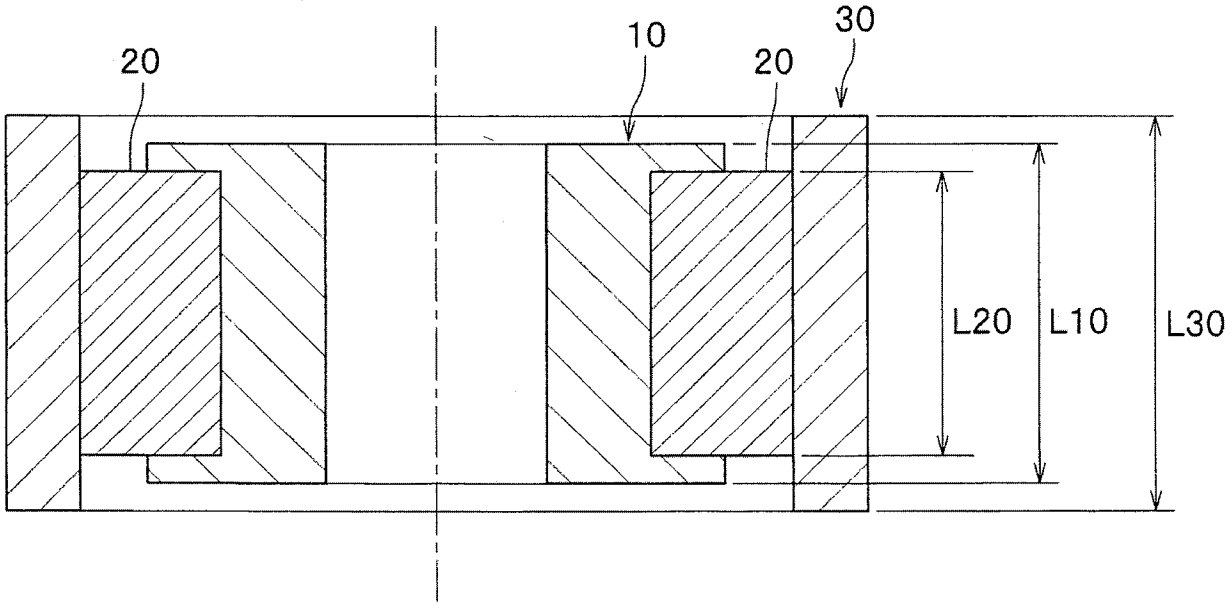
FIG. 4 is a view illustrating a relationship between respective lengths of a rotor, a vane, and a cam ring in an axial direction of a shaft of the vane pump unit, corresponding to a cross-section taken along X2-X2 in FIG. 1.
Figure 5A:
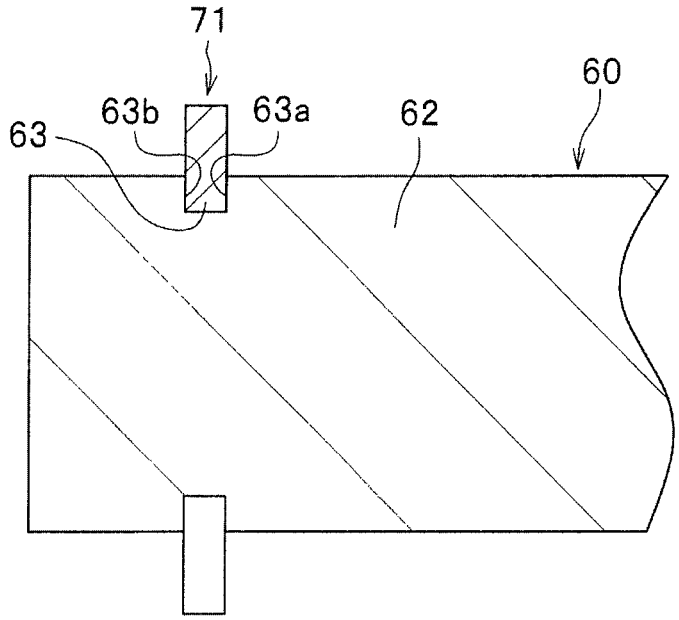
FIGS. 5A and 5B are views of a connecting bar and a clip according to the embodiment, and are a side cross-sectional view and a front view, respectively.
Figure 5B:
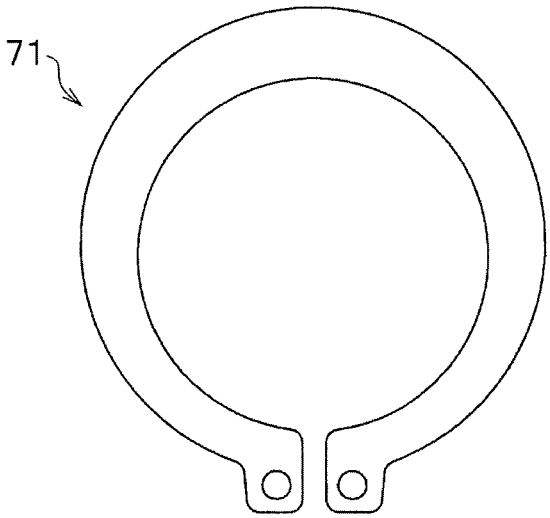

The rotor 10, the vane 20, and the cam ring 30 have a height of L10, a height of L20, and a height of L30, respectively, and have a relationship of "L30>L10>L20" in the axial direction (refer to FIG. 4). Accordingly, when the cam ring 30 is interposed between the first plate 40 and the second plate 50, very small gaps (clearances) are formed in the axial direction between the rotor 10, the vanes 20, and the first plate 40 and/or the second plate 50. Accordingly, the rotor 10 and the vane 20 are allowed to rotate, while the vanes 20 slide easily with respect to the first plate 40 and/or the second plate 50 in the radial direction.

First Plate and Second Plate

The first plate 40 and the second plate 50 are plates having a thickness that interpose the rotor 10 and the cam ring 30 therebetween in the axial direction.

The first plate 40 is disposed on an end surface side (a right side in FIGS. 2 and 3) of the rotor 10 and the cam ring 30. A concave supporting portion 41 is formed at the center of the first plate 40 so as to support a first end portion 18 of the shaft 16. The first end portion 18 of the shaft 16 is rotatably supported via a bearing 18*a* by the supporting portion 41. A press-fit hole 42 is formed in an outer circumferential edge portion of the first plate 40, and a first end portion 61 of the connecting bar 60 is press fitted into the press-fit hole 42.

The second plate 50 is disposed on the other end surface side (a left side in FIGS. 2 and 3) of the rotor 10 and the cam ring 30. A through-hole 51 is formed at the center of the second plate 50, and a second end portion 19 of the shaft 16 passes through the through-hole 51. The second end portion 19 of the shaft 16 passes through the through-hole 51, and is rotatably supported via a bearing 19*a*. An outer circumferential edge portion of the second plate 50 is provided with a through-hole 52 through which a second end portion 62 of the connecting bar 60 passes, and the through-hole 52 has an inner diameter greater than the outer diameter of the connecting bar 60. The diameter of an end portion (a left end portion) of the through-hole 52 is enlarged. An accommodating portion 53 has a hole shape opened to the outside, and accommodates a clip 71.

Connecting Bar

The connecting bar 60 is a bar that connects the first plate 40 and the second plate 50. The first end portion 61 of the connecting bar 60 is press fitted into the press-fit hole 42. A second end portion 62 of the connecting bar 60 protrudes from an end of the second plate 50. A groove 63 is formed in the second end portion 62 so as to extend in the circumferential direction, and the clip 71 is attached into the groove 63 (refer to FIGS. 3 and 5A).

The clip 71 is in contact with a first contact surface 63*a* on one end side, and a second contact surface 63*b* on the other end side, which surround the groove 63 in the axial direction. That is, the clip 71 is inserted into the groove 63, and is interposed between the first contact surface 63*a* and the second contact surface 63*b*, thereby the position of the clip 71 is determined with respect to the connecting bar 60 in the axial direction. Accordingly, the clip 71 is prevented from moving to the one end side of the connecting bar 60. As a result, the second plate 50 is prevented from undergoing concave bending.

Clip

The clip 71 is a retainer that is retained in the groove 63 of the second end portion 62, and prevents the second plate 50 and the cam ring 30 from slipping out of the connecting bar 60. The clip 71 has a C shape when seen in the axial direction, and has a spring force that allows a tip portion of the clip 71 to be openable and closeable (refer to FIG. 5B).

Axial Position of Groove and Position of Retaining Clip

Here, the axial position of the groove 63, that is, the position of retaining the clip 71 will be described.

Before the clip 71 is assembled into the housing 100 (refer to FIG. 3), the retaining of the clip 71 (the axial position of the groove 63) is set to be positioned in a place such that a gap 75 is formed at least either between the first plate 40 and the cam ring 30 or between the second plate 50 and the cam ring 30 as illustrated in FIG. 3. That is, before the clip 71 is assembled into the housing 100, the position of retaining the clip 71 is set in such a manner that the first plate 40 and the second plate 50 are not in press contact with the cam ring 30, and interpose the cam ring 30 therebetween, without pressure being applied to the cam ring 30. Accordingly, before the clip 71 is assembled into the housing 100, the first plate 40 and the second plate 50 do not bend in the axial direction (in a plate thickness direction).

In contrast, after the clip 71 is assembled into the housing 100 (refer to FIG. 2), the clip 71 is accommodated in the hole-shaped accommodating portion 53, and the housing main body 110 and the cover 120 interpose the first plate 40, the cam ring 30, and the second plate 50 therebetween in the axial direction, and the first plate 40 and the second plate 50 are brought into close contact with the cam ring 30.

Method of Assembling Vane Pump (Action Effects)

First, a method of assembling the vane pump unit 1 will be described.

The first end portion 61 of the connecting bar 60 is inserted and press fitted into the press-fit hole 42 of the first plate 40. For example, (1) when the first end portion 61 is brought into contact with a bottom surface of the press-fit hole 42, the press-fit length of the first end portion 61 is set to become a predetermined length as designed. Alternatively, (2) a protrusion for determining the axial position is formed on an outer circumferential surface of the first end portion 61, and when the protrusion is brought into contact with the first plate 40, the press-fit length is set to become a predetermined length as designed.

Subsequently, the first end portion of the shaft 16 joined with the rotor 10 via a serration connection is inserted into the supporting portion 41, thereby the rotor 10 equipped with the vanes 20 is stacked on the first plate 40. In parallel, the connecting bar 60 is inserted through the through-hole 32 of the cam ring 30 that surrounds the rotor 10, thereby the cam ring 30 is also stacked on the first plate 40.

Subsequently, the shaft 16 is inserted through the through-hole 51 of the second plate 50, and the connecting bar 60 is inserted through the through-hole 52 of the second plate 50, thereby the second plate 50 is stacked on the rotor 10 and the cam ring 30. In this state, the second end portion 62 of the connecting bar 60 protrudes from the second plate 50.

Subsequently, the clip 71 is attached into the groove 63 of the connecting bar 60. As a result, the vane pump unit 1 is obtained.

Since the clip 71 is attached in this state, the second plate 50, the cam ring 30, the rotor 10, and the like are prevented from slipping out of their respective positions. Accordingly, the second plate 50 and the like are prevented from slipping out of their respective position during the transportation of the vane pump unit 1, and it is easy to handle the vane pump unit 1.

In this state, the first plate 40 and the second plate 50 are not in press contact with the cam ring 30, and the first plate 40 and the second plate 50 do not bend.

Subsequently, a method of assembling the vane pump 200 will be described.

The accommodating chamber 111 of the housing main body 110 accommodates the vane pump unit 1. Subsequently, the housing main body 110 and the vane pump unit 1 are covered with the cover 120, and the housing main body 110 and the cover 120 are tightened together with the bolt 131.

Accordingly, the housing 100 interposes the vane pump unit 1 in the axial direction, that is, the housing main body 110 and the cover 120 interpose the first plate 40, the second plate 50, and the cam ring 30 therebetween, and the first plate 40 and the second plate 50 are brought into close contact with the cam ring 30.

As a result, the vane pump 200 is obtained.

In regard to manufacturing the vane pump unit 1, and the vane pump 200, for example, after the vane pump unit 1 is manufactured in a main factory (a major factory), and is transported to sub-factories everywhere, it is possible to manufacture the vane pump 200 by assembling the vane pump unit 1 into the housing 100 in each sub-factory. At this time, since the connecting bar 60 is retained by the clip 71, the second plate 50 and the like are prevented from slipping out of their respective positions during the transportation of the vane pump unit 1 from the main factory to each of the sub-factories, and the first plate 40 and the second plate 50 also do not bend. Since the sub-factory does not require equipment for assembling the vane pump unit 1, it is possible to save space at the sub-factory, and manufacture the vane pump 200 at low costs.

Modification Example

The embodiment of the present invention is described above, the present invention is not limited to the embodiment. For example, the following modifications may be made.

Figure 6A:
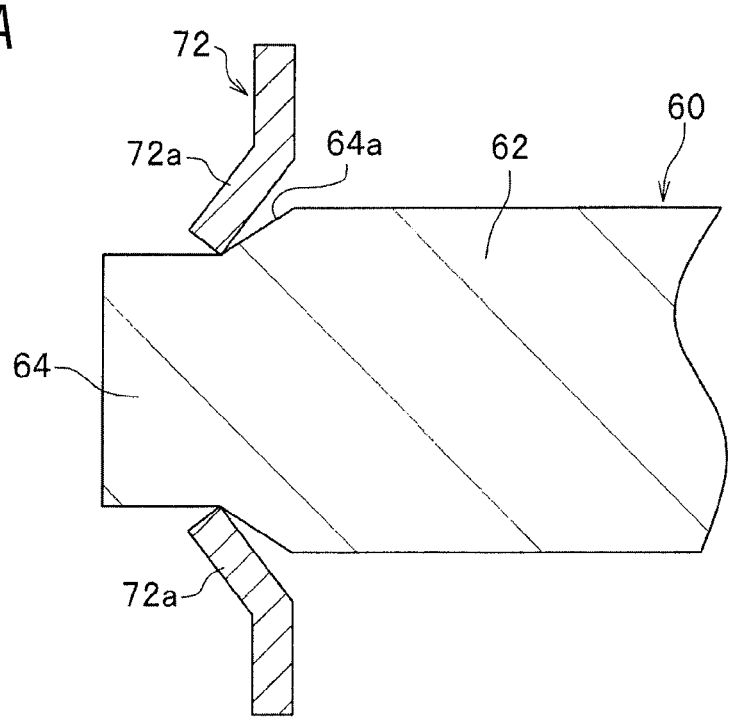
FIGS. 6A and 6B are views of a connecting bar and a clip according to a modification example, and are a side cross-sectional view and a front view, respectively.
Figure 6B:
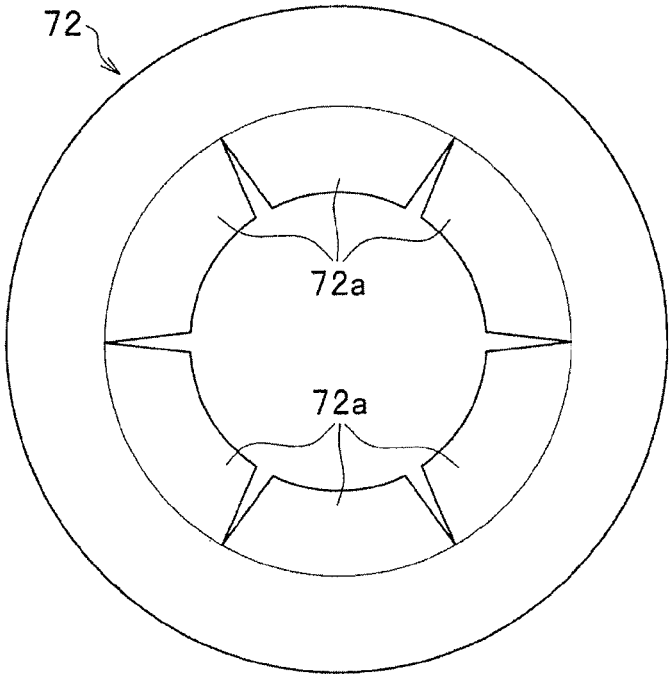

The connecting bar 60 and a clip 72 may have a configuration as illustrated in FIGS. 6A and 6B. As illustrated in FIG. 6A, the second end portion 62 of the connecting bar 60 is provided with a stepped small-diameter portion 64 having a reduced diameter, and a stepped surface of the small-diameter portion 64 forms a contact surface 64*a* that is in contact with the clip 72. The clip 72 has a ring plate shape. A plurality of slits are formed in an inner circumferential edge portion of the clip 72 at equal intervals in the circumferential direction so as to extend outwardly in the radial direction, and thus the inner circumferential edge portion is divided into a plurality of spring pieces 72*a*. When the small-diameter portion 64 is inserted into the clip 72, the plurality of spring pieces 72*a* are brought into press contact with the outer circumferential surface of the small-diameter portion 64, and the clip 72 is attached to the connecting bar 60.

Figure 7A:
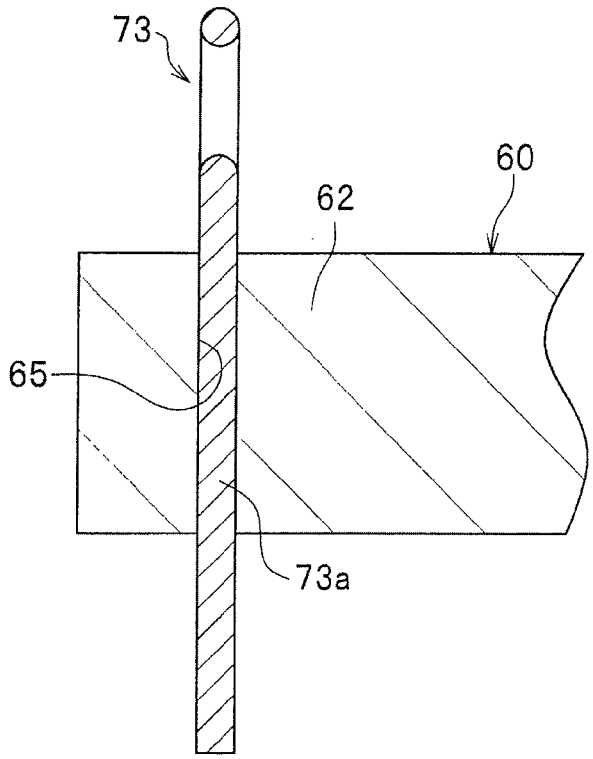
FIGS. 7A and 7B are views of a connecting bar and a clip according to another modification example, and are a side cross-sectional view and a front view, respectively.
Figure 7B:
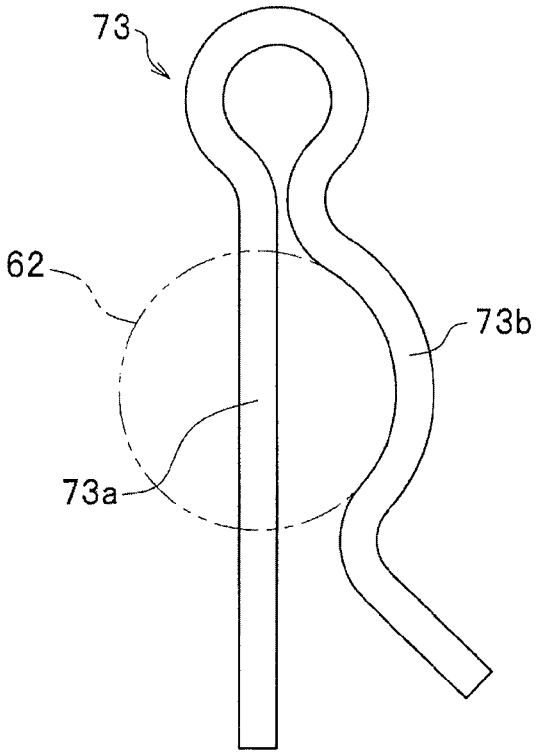

The connecting bar 60 and a clip 73 may have a configuration as illustrated in FIGS. 7A and 7B. As illustrated in FIG. 7A, an insertion hole 65 is formed in the second end portion 62 of the connecting bar 60 so as to extend in the radial direction. The clip 73 includes an insertion piece 73*a* that is inserted into the insertion hole 65, and a press-contact piece 73*b* that is in press contact with the outer circumferential surface of the second end portion 62.

What is claimed is:

1. A vane pump unit comprising:

a rotor;

a plurality of vanes that are slidably provided in the rotor;

an cam ring that surrounds the rotor and the plurality of vanes;

a first plate that is disposed on one end surface side of the rotor;

a second plate that is disposed on the other end surface side of the rotor;

a connecting bar that passes through the cam ring in an axial direction, and has a first end portion fixed to the first plate, and a second end portion which passes through the second plate and then protrudes from the second plate; and a retainer that is retained in the second end portion of the connecting bar, the retainer being configured to prevent the second plate and the cam ring from slipping out of the connecting bar, wherein the retainer is placed at the second end portion to secure the second plate and the cam ring such that the secured cam ring and the secured second plate are displaceable along the connecting bar.

2. The vane pump unit according to claim 1, wherein the second end portion of the connecting bar is provided with a contact surface that is in contact with the retainer in the axial direction.

3. The vane pump unit according to claim 2, wherein the second end portion of the connecting bar is provided with an attachment groove into which the retainer is attached, and which extends in a circumferential direction of the connecting bar, and the retainer has a C shape when seen in the axial direction.

4. The vane pump unit according to claim 1, wherein the second end portion of the connecting bar is provided with an attachment groove into which the retainer is attached, and which extends in a circumferential direction of the connecting bar, and the retainer has a C shape when seen in the axial direction.

5. The vane pump unit according to claim 1, wherein, the connecting bar is partially received within the first plate and passes through the second plate and the cam ring and is secured by the retainer.

6. A vane pump comprising:

a housing; and the vane pump unit according to claim 1, wherein when the vane pump unit is accommodated in the housing, the housing interposes the vane pump unit in the axial direction in such a manner that the first plate and the second plate are in close contact with the cam ring.

7. The vane pump according to claim 6, wherein a surface of the retainer facing toward the second plate is spaced away from the second plate.

* * * * *